US005524891A

United States Patent [19]

Owen, Jr. et al.

[11] Patent Number: 5,524,891

[45] Date of Patent: Jun. 11, 1996

[54] GOLF PRACTICE HOLE WITH VARIABLE DIAMETER RIM

[75] Inventors: A. James Owen, Jr., 220 Argilla Rd., Ipswich, Mass. 01938; Henry St. Louis, Jr., West Ossipee, N.H.; James P. Richardson, Cambridge, Mass.

[73] Assignee: A. James Owen, Jr., Ipswich, Mass.

[21] Appl. No.: 479,512

[22] Filed: Jul. 7, 1995

[51] Int. Cl.[6] ..... A63B 69/36

[52] U.S. Cl. ..... 473/196; 473/179

[58] Field of Search ..... 273/178 R, 179 R, 273/179 A, 179 B, 179 C, 179 D, 179 E, 178 B, 34 B, 176 F, 176 H

[56] References Cited

U.S. PATENT DOCUMENTS

| | | | |
|---|---|---|---|
| 1,558,767 | 10/1925 | Smith . | |
| 3,595,581 | 7/1971 | Anderson et al. | 273/176 H |
| 4,275,886 | 6/1981 | Bannon | 273/176 H X |
| 4,280,698 | 7/1981 | Troiano | 273/34 B |
| 4,743,027 | 5/1988 | Simjian | 273/176 H X |
| 5,078,394 | 1/1992 | Kretz | 273/34 B |
| 5,205,559 | 4/1993 | Plopper | 273/177 R |
| 5,308,075 | 5/1994 | Theriault | 273/195 A |
| 5,356,147 | 10/1994 | MacDonald | 273/195 A |
| 5,390,926 | 2/1995 | Hanson et al. | 273/178 B |
| 5,431,403 | 7/1995 | Pelz | 273/34 B X |

FOREIGN PATENT DOCUMENTS

| | | | |
|---|---|---|---|
| 220377 | 8/1924 | United Kingdom | 273/34 B |

OTHER PUBLICATIONS

Birdiemaster Products Sheet.

Eastern Hi–Tech Series of Golf Accessories Product Sheet, Nos. 033–03301, 033–03303, 033–03305 and 033–03306.

*Primary Examiner*—George J. Marlo

*Attorney, Agent, or Firm*—Wolf, Greenfield & Sacks

[57] ABSTRACT

A golf practice hole with a variable diameter rim provides a flexible material positioned over a series of radially-movable supports that each define a portion of an edge or rim of a hole. The flexible material is typically provided with expansion areas that can include slits that define separate flaps of material. The flaps of material are tensioned beneath the movable supports to maintain the flaps in engagement with the supports. As the supports are moved radially-inwardly and radially-outwardly, the material follows the supports and defines a continuous surface above the rim throughout a range of movement of the supports. The range of movement defines a corresponding range of hole rim diameters. The flexible surface remains free of discontinuities and breaks despite diametral changes in the rim and provides an improved playing surface.

25 Claims, 15 Drawing Sheets

66
64
66
56
56
56

GOLF PRACTICE HOLE WITH VARIABLE DIAMETER RIM

FIELD OF THE INVENTION

This invention relates to a golf training device that includes a practice hole having a rim that is variable in diameter, and more particularly to a rim that is continuously variable in diameter without breaks or interruptions in the surrounding surface of the rim.

BACKGROUND OF THE INVENTION

The ever-increasing popularity of golf has led to the development of innumerable training devices that purport to improve playing proficiency. Playing golf proficiently requires a combination of skills including a controlled, powerful, swing for driving and a concentrated, accurate, stroke for putting. Training devices for improving putting skills have traditionally involved the use of a mat of carpet that simulates a green and a rimmed hole at a location on the mat that is sized and shaped to simulate an actual golf hole. By continually putting a golf ball across the mat, the player improves his or her skills, with the goal of directing the ball to the hole in a single shot every time.

It is well known that the repetition of a particular physical activity develops a player's motor skills. These motor skills become part of the player's permanent subconscious memory. In golf, a player attempts to train his or her muscles to automatically provide a given power and direction of stroke to propel a golf ball of a predetermined size and weight toward, and into, a hole having a slightly larger predetermined size. During the training process, the player relies upon vision to correctly align his or her movements with the center of the hole and receives kinesthetic feedback from the act of hitting the golf ball and watching it move toward the hole. Over time, the player improves his or her movements in response to visual and kinesthetic feedback until the ball is more-accurately directed toward, and into, the hole.

It has been contemplated that reducing the diameter of the hole can improve a player's skill by requiring the player to focus on a smaller target when shooting. Directing a ball into an undersized hole requires greater accuracy and control than required for a conventionally-sized hole. The prior art has employed various inserts that are overlaid onto a conventionally-sized hole in order to reduce the hole's diameter. One disadvantage of such inserts is that they invariably generate an uneven surface where the insert meets the original hole rim. Thus, part of the kinesthetic and visual feedback from putting into a normal hole is lost and, in fact, the border between the rim and insert may act as a deflector that prevents the ball from proceeding to the hole in a predictable and relatively-straight path.

It has been further contemplated that a golf ball having an increased diameter can be employed with a conventionally-sized hole. However, even if such a golf ball has the same general weight and feel as a conventional ball, its larger size disrupts the visual and kinesthetic feedback that the player experiences.

It is most-desirable to maintain a standard ball size and to provide a smaller rim diameter for the golf hole. Once a player has adapted to scoring effectively with a smaller hole, his or her concentration is enhanced, and accuracy is enhanced. When returning to a larger hole, the player generally experiences a substantial increase in scoring probability.

It is, therefore, an object of this invention to provide a method and apparatus for defining a golf hole, or other, similar, goal or hole in a playing surface, having a rim that is variable in diameter, without substantial disruption of the surrounding surface of the hole. The rim of the hole should be variable in diameter over a substantially continuous range of values. The surface should be largely similar to an authentic playing surface and the appearance of the rim should be, likewise, similar to that of a conventional rim. The mechanism that varies the rim diameter should be adaptable for use in a portable training device and/or should be mountable on a conventional golf green. The mechanism of the rim should lend itself to automated control in which a player can remotely operate the mechanism to change the rim diameter from a distance. The mechanism should be reliable and designed for long life under adverse conditions.

SUMMARY OF THE INVENTION

This invention provides an improved variable-diameter golf practice hole that avoids the disadvantages of the prior art by enabling the user to vary the hole's diameter while maintaining a continuous and substantially-unbroken surface around the rim, that, at all diameters, appears to be a continuous surface. In a broad sense, the training device comprises a surface having a support mechanism that defines a rim that is movable between a minimum and maximum diameter. The rim can be broken in places, but typically, approximates a circle. A flexible surface is located over the support mechanism and is wrapped beneath the rim of the mechanism giving the appearance of a continuous, uninterrupted, hole edge. The flexible material includes expansion areas that allow it to be wrapped beneath the supports. The flexible surface is tensioned so that it remains in engagement with the supports as the supports move to change the diameter of the rim.

According to one embodiment of the invention, the flexible material covering can define a grass mat-like material with a center having a plurality of expansion areas extending radially outwardly from the center. The expansion areas can comprise a series of slits that form the flexible material surface into flaps and each of the flaps can be tensioned by a spring that passes under at least one of the supports.

The supports can comprise a plurality of tongues that are movable radially between a minimum radial extension and a maximum radial extension relative to the center. The tongues, in this embodiment, engage the flexible material surface adjacent to the expansion areas and the flexible material is specifically wrapped about the tongue so that the material defines a rim of a hole whereby radially movement of the tongues changes the diameter of the rim.

The number of flaps can correspond to the number of tongues and the flaps can each be aligned to rest fully on a respective tongue, or the flaps can overlap a pair of tongues. When the flaps overlap a pair of tongues, they tend to fill a gap that is typically present between tongues when the tongues are located at a more-radially-outward position. The tongues can include linkages that interengage respective slots in a movable ring or plate. The slots are arranged so that rotation of the ring or plate causes the linkages, that ride within the slots, to translate radially relative to the center. All linkages move a similar radial distance for a given rotation of the ring or plate so that the rim diameter expands equally about the entire circumference. The ring or plate can be powered by a motor interconnected with a remote control that is adjacent the player.

The training device can further include a variable geometry cup located within the hole having a set of segments attached to each tongue that define upper and lower rims of the cup. The segments can capture a piece of flexible sheet material that forms the wall of the cup. The flexible sheet material overlaps and freely slides upon itself to expand and contract as the tongues move radially. Similarly, the bottom of the cup can be open and can lead to a ball return ramp that directs a ball back to the player after it enters the hole.

A method for changing a diameter of a rim of a golf practice hole according to this invention includes the step of providing a surface having an open center and providing supports on the surface. The supports each define a portion of an edge of a rim of a golf practice hole. A flexible material is located over the surface and the material is wrapped about the supports so that the material extends beneath the surface. The material is movably tensioned at a location beneath the surface to define a rim of the material at a location which the material is wrapped about the supports. The supports are moved toward and away from the open center to change a diameter of the rim. The supports can be moved in an approximate radial direction and the material can be divided into a plurality of flaps by radial cuts. Each of the flaps is located adjacent at least one of the supports.

BRIEF DESCRIPTION OF THE DRAWINGS

The objects, advantages and features of the invention will become more clearly appreciated from the following detailed description when taken in conjunction with the drawings in which.

DETAILED DESCRIPTION

Figure 1:
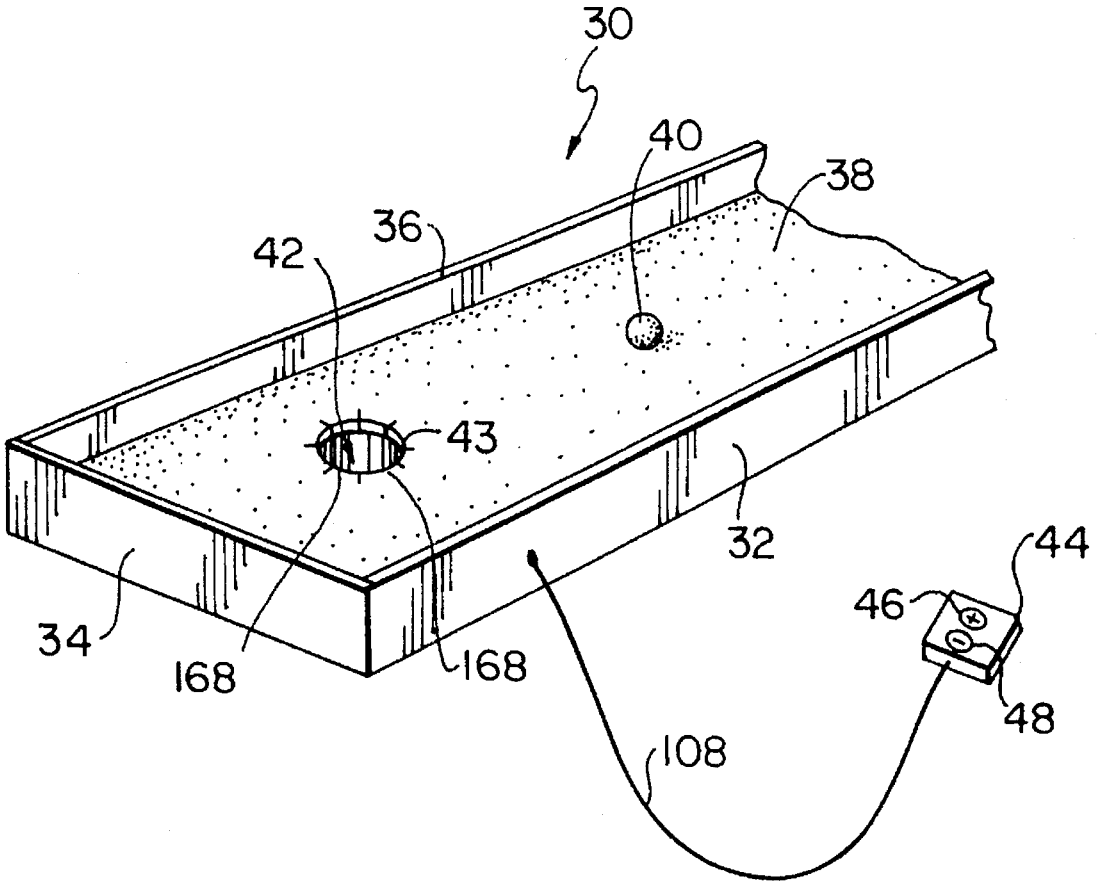
FIG. 1 is a perspective view of a golf training device with practice hole according to this invention.

FIG. 1 illustrates a training device 30 for use in improving golf putting skills according to this invention. Training device 30 according to this embodiment features a set of upright walls 32, 34 and 36 that extend upwardly above a playing surface 38. Playing surface 38 can be constructed from a variety of materials. In this embodiment, the material of playing surface 38 is simulative of a putting green and can be constructed from "Putting Turf"™ constructed by Putting Greens International, Inc. "Putting turf" is a synthetic grass product that normally includes an upper tufted grass layer on a flexible textile base and a lower non-skid foam layer. In this embodiment, the foam layer is removed to provide the material with greater flexibility and slidability. It is contemplated, however, that a variety of surfaces can be utilized according to this invention. As discussed further below, the surface material should be generally flexible so that it can be formed about a narrow rim relatively easily.

In this embodiment, a golf ball 40 that is conventional in size, shape and weight, is directed by a player along surface 38 to a practice hole 42. Practice hole 42, according to this embodiment, defines a generalized rim 43 that can be varied in diameter. The diameter of practice hole 42, according to this embodiment, is controlled by a remote control pedal 44 having a pair of buttons 46 and 48 for increasing and decreasing, respectively, the size of the diameter of practice hole 42.

While training device 30 is depicted in FIG. 1 as a self-contained box-like structure with raised walls 32, 34 and 36, it is contemplated that a variety of shapes and sizes of training device structures can be implemented according to this invention. For example, the training device can be constructed as a smaller insert adapted for placement in a recess in a standard outdoor putting green. In such an embodiment, the sidewalls of the training device are beneath the putting surface, or are omitted, so that a ball can pass freely from the curtilage of the putting green onto the adjacent putting surface 38 of the training device. It is important primarily that the putting surface continuously surround a rim of practice hole 42. This invention, therefore, relates to the construction and control of a variable diameter practice hole in a putting surface that is substantially continuous and free of interruptions.

FIGS. 2–5 illustrate the operating mechanism for a practice hole according to a preferred embodiment of this invention. The golf hole adjustment mechanism is, in substance, a multi-tiered structure that is, in this embodiment, housed within sidewalls 32, 34 and 36. As described above, the exposed outer surface of the mechanism is the flexible playing surface 38. Playing surface 38 defines a central hole 42 based upon a plurality of flaps 50 formed by a series of radial cuts (168) that extend outward from the approximate center of the hole to a predetermined radial distance. The cuts or slits (168), as shown in FIG. 1, between flaps 50 define "expansion areas" that are described further below.

Flexible playing surface 38 is secured by, for example, adhesive to a rigid plate 52 that defines a central hole 54 having a diameter D that, in this embodiment, is approximately 7 inches. Playing surface material 38 is cemented to plate 52 so that playing surface 38 remains flat and continuous adjacent hole 42. In this embodiment, plate 52 can comprise a plastic or metallic material having a thickness of approximately 1/16 inch or less. Beneath plate 52 is located the operative mechanism for varying the diameter of hole 42. A series of radially aligned tongues 56 are located on a base plate 38. Base plate 58 provides primary support for a series of movable supports or "tongues" 56 and for playing surface 38. Base plate 58 includes a central hole 59 with a diameter D1 that equals approximately 5¼ inches. Base plate 58 includes a series of radial slots 60 that, in this embodiment, engage corresponding guide pins 62. Ball bearings 64 are located at the outer ends of guide pins 62. Bearings 64 extend beneath base plate 58 and each engage respective slots 66 in an adjustment ring 68.

Tongues 56 are free to move radially toward and away from a center of hole 42 between separators 70. Tongues 56 and separators 70 typically have a thickness that is approximately equal so that, in combination, tongues 56 and separators 70 define a substantially continuous surface that supports plate 52. In this embodiment, tongues 56 include sloped side walls 72 that engage oppositely sloped side walls 74 on respective separator 70. Separators 70 are secured to base plate 58 by screws 78. Interengagement between side walls 74 of separator 70 and side walls 72 of tongues 56 retains tongues 56 against base plate 58 free of axial movement. However, tongues 56 are free to move radially toward and away from a center X of hole 42.

Since bearings 64 of guide pins 62 engage respective slots 66 in ring 68, tongues 56 are each retained radially at a predetermined position relative to a center X of the hole 42. Each of slots 66 are angled (Angle A) relative to a tangent 75 of ring 66. Thus, as ring 66 rotates, tongues 56 are moved simultaneously radially inwardly or radially outwardly by slots 66. In this embodiment, each of slot 66 are located so that each tongue is positioned at an approximately identical distance from a center of the hole 42 when each end bearing 64 engages a respective slot 66. In other words, in this embodiment there are twelve tongues 56. Likewise, there are twelve corresponding slots 66. Each slot 66 is positioned about the perimeter of ring 68 so that its radially inwardmost 80 and radially outwardmost end 82 is aligned adjacent a respective guidepin end bearing 64 of a respective tongue 56. In this embodiment the ends comprise 0.5 inch O.D. ball bearings for reduced friction. Similarly, each radially inwardmost end 80 and radially outwardmost end 82 of each slot 66 is positioned radially on ring 68 at a similar distance relative to a center of ring 68.

It is contemplated that ring 68 can be square, ovular or another shape. So long as slots 66 are disposed about a circle having its center at an axis of rotation of ring 68, the mechanism will operate properly.

In this embodiment, ring 68 is an annulus and is supported on four bearing supports 88 that are each mounted to bottom plate 90. Supports 88 include respective bearings 92 and 94 that cradle ring 68 and limit both axial and radial movement of ring 68. In this embodiment, radial bearings 94 engage an inner circumference 96 of ring 68. Axial bearings 92, likewise, engage a lower face 98 of ring 68. Axial bearings 92 and radial bearings 94 can comprise 1.0 inch O.D. ball bearings. This bearing arrangement requires that at least a portion of inner circumference 96 be circular and have a circumference centered about a center of rotation. An advantage of ring 68 according to this embodiment is that it includes an open center defined by inner circumference 96. Thus, ring 68 does not interfere with a passageway defined by a hole 42.

Each tongue 56 includes an inner end 100 that, in this embodiment, is substantially straight and defines a perpendicular line relative to the radial direction. The ends 100, in substance, define a rim of the golf practice hole 42 according to this embodiment. Since, however, ends 100 define a rim of a substantially circular hole 42, they can also be provided with a curvature.

Figure 3:
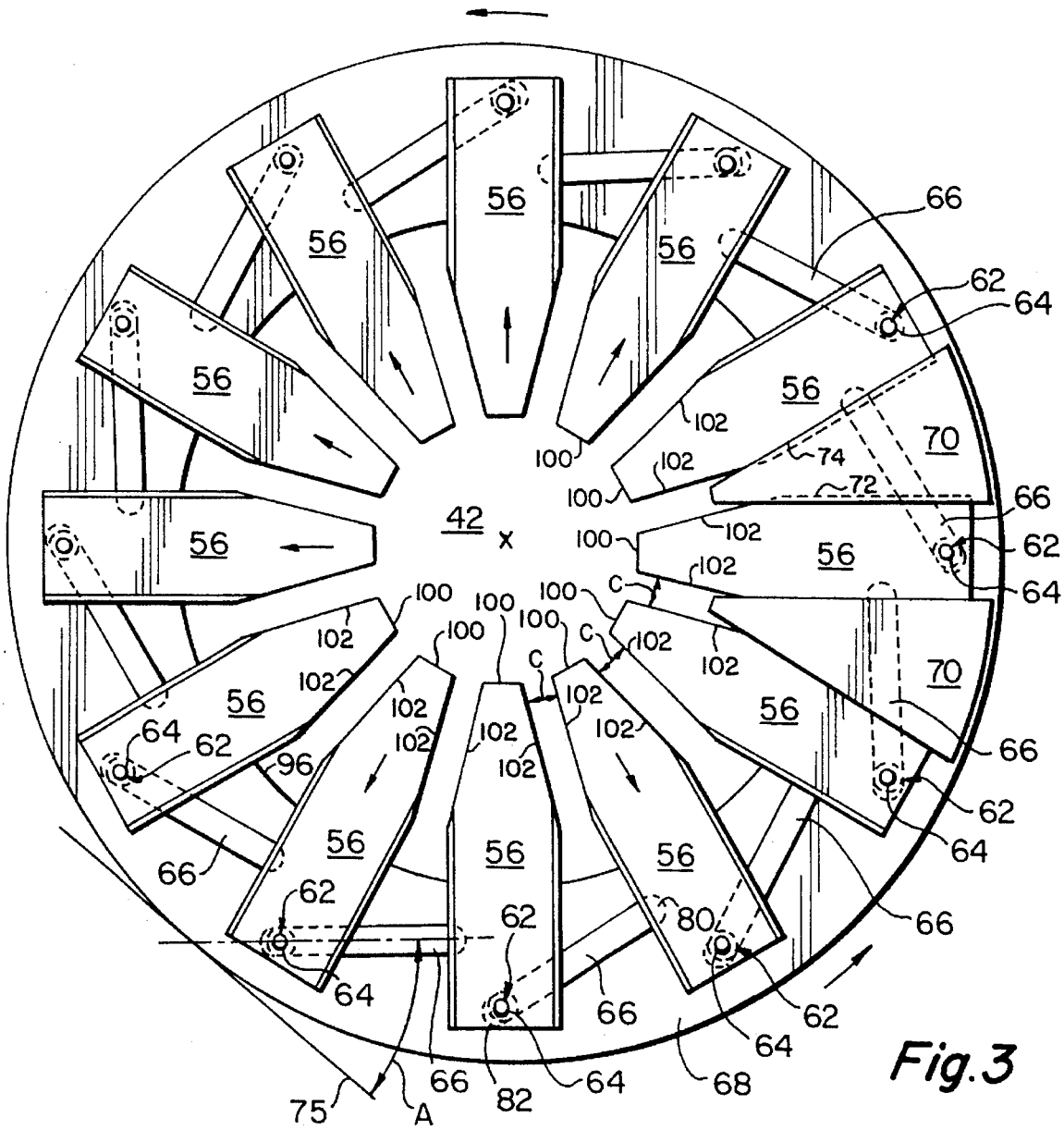
FIG. 3 is an exposed plan view of the practice hole mechanism of FIG. 2 wherein the hole is defined by a maximum diameter rim.
Figure 4:
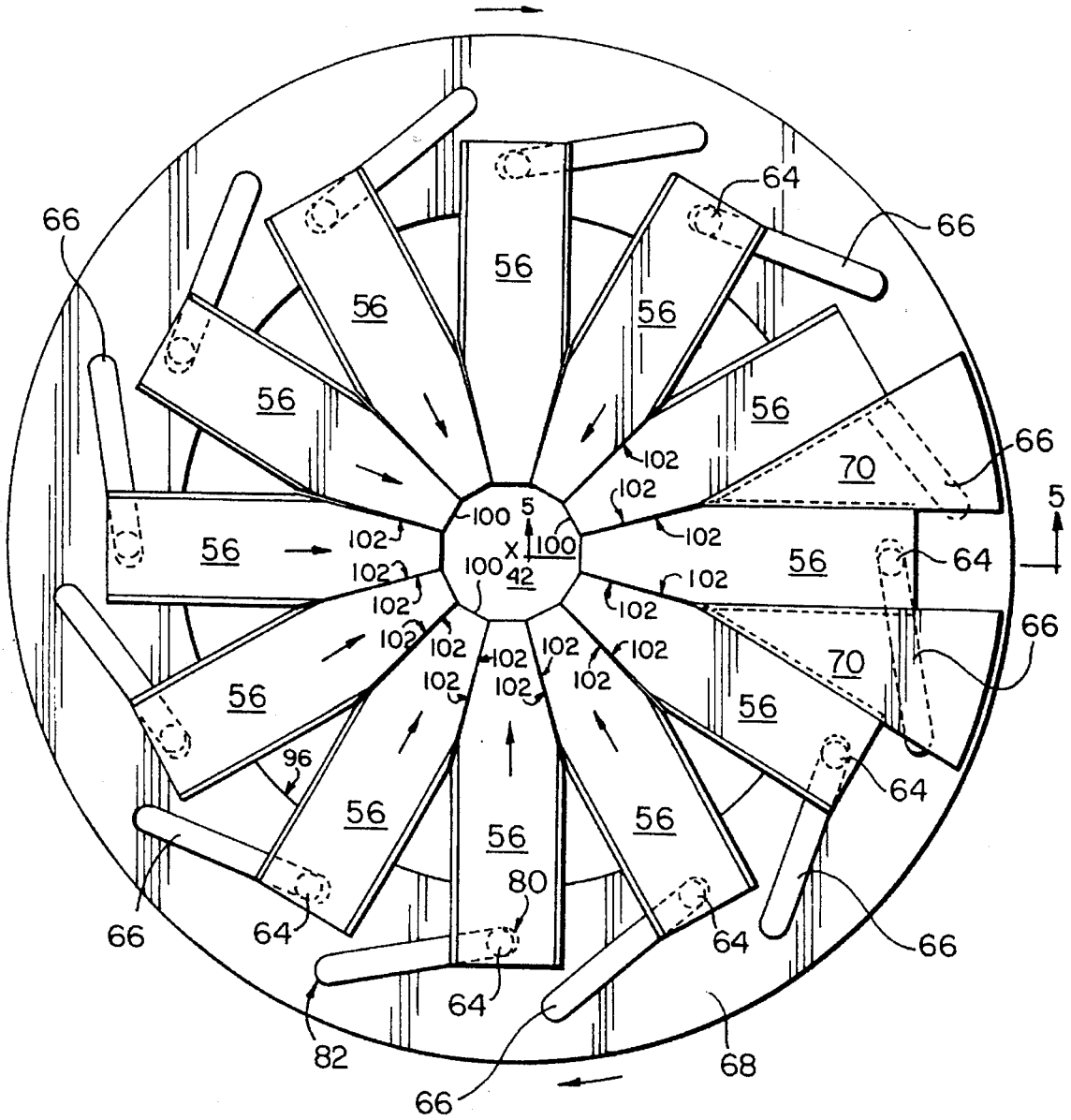
FIG. 4 is an exposed plan view of the practice hole mechanism of FIG. 2 wherein the hole is defined by a minimum diameter rim.

As described in FIGS. 3 and 4, movement of ring 68 translates each of tongues 56 radially toward and away from a center X of the hole 42. When each guide pin end 64 is adjacent a radially outwardmost end 82 of a respective slot 66 (FIG. 3), tongues 56 are in a radially outwardmost position relative to a center of the hole. Thus, a maximum diameter rim is defined. Conversely, when ring 68 is rotated so that guide pin ends 64 are adjacent a radially inwardmost end 80 of a respective slot 66 (FIG. 4), ends 100 are translated to a position that is a minimum radial distance from a center X of the hole 42. Thus, the ends 100 define a minimum diameter hole.

Each tongue 56 includes inwardly angled sides 102 that are sized and arranged to provide clearance or gap C (FIG. 3) between tongues 56 as tongues 56 are moved radially inward toward a center of hole 42. The clearance C is chosen so that, when each guide end 64 is at a radially inwardmost position 80 of a respective slot 66, the ends 100 converge to form a substantially-continuous hole rim (FIG. 4). As intermediate-sized rims are selected by partial rotation of ring 68, the clearance C becomes smaller and the ends 100 are brought closer together. In this embodiment, the tongues are specifically sized and arranged to define a maximum diameter rim of approximately 5½–5¼ inches and a minimum diameter rim of approximately 3 inches. When the playing surface material is overlaid onto ends 100 of tongues 56, the actual minimum diameter of hole 42 is approximately 2 inches. Likewise, the actual maximum diameter is approximately 4½ inches. The minimum and maximum hole diameters can, of course, be larger or smaller than the above-described values depending upon the application of the training device.

Figure 2:
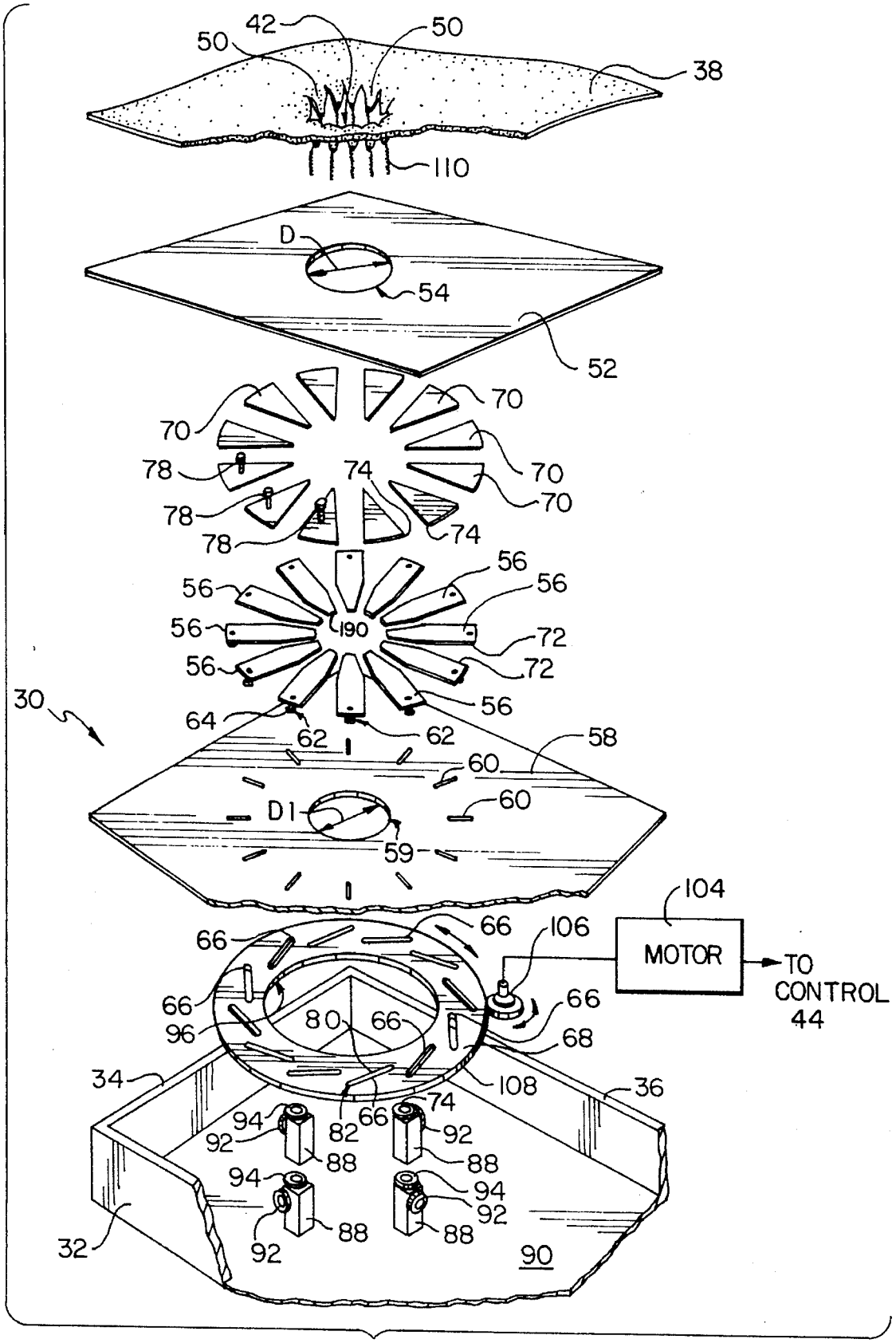
FIG. 2 is an exploded perspective view of the practice hole mechanism according to this invention.

With reference to FIG. 2, ring 68 can be rotated to select a radial positioning of tongues 56 by a motor 104. Motor 104 can drive a gear or wheel 106 that engages an outer perimeter 108 of ring 68. According to one embodiment, a rack can be provided around the outer perimeter 108 and gear 106 can engage the rack. Motor 104 can be interconnected to remote control 44 (FIG. 1) having a wire 108 that enables control 44 to be located adjacent a player. Likewise, motor 104 can be controlled by any acceptable control system including a remote radio or infra red controller held by the player that activates a receiver on the training device 30.

Figure 5:
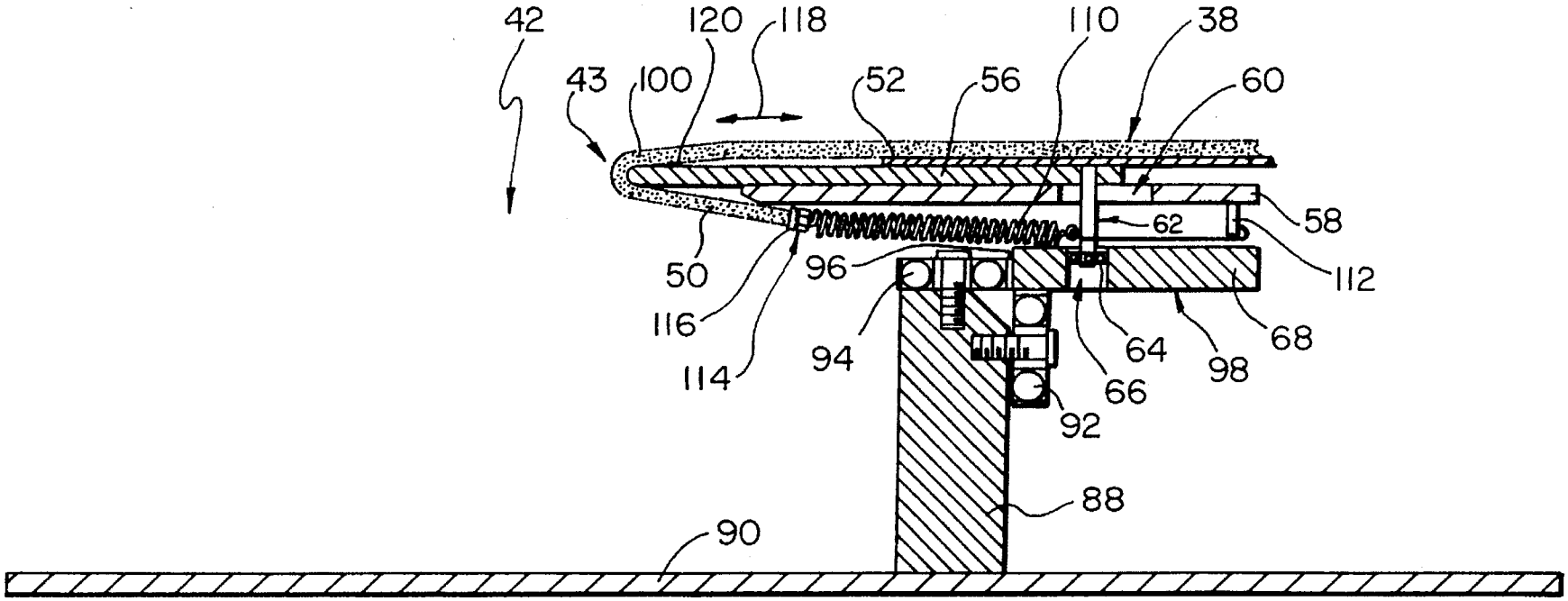
FIG. 5 is a side cross-section of the practice hole mechanism taken along line 5—5 of FIG. 4.

With reference to FIG. 5, tongues 56 move radially-inwardly and outwardly to alter a rim size of the hole 42. Playing surface 38 is a flexible material, similar to grass, that is overlayed so that each flap 50 engages a respective tongue 56. The separations, or expansion areas, between flaps 50 enable each flap 50 to be wrapped around an underside of each tongue 56 since wrapping the material back on itself around a circular rim typically requires tangential expansion (perpendicular to the radial direction). In this embodiment, each flap 50 is attached by a tension spring 110 to a lug 112 on base plate 58. In this embodiment, the tension springs utilized can comprise 0.035 inch diameter springs having an overall free length of 2¾ inch and rated at 1.2 pounds per inch. Such springs can be constructed from zinc plated high carbon steel. Alternatively, 0.028 inch wire diameter music wire springs having an overall free length of 2½ inch and 0.42 pounds per inch of tension can be utilized.

Alternatively, any conventional spring material, such as elastic shock cords, can be substituted for the springs 110. The springs 110 are joined to the ends 114 of each flap 50 by, this embodiment, a grommet 116 that is secured to flap end 114. The grommet should be located so that it supports the spring without causing tearing of the flap material under tension and parted by spring 110.

The tension imparted by each spring 110 should be sufficient to maintain each fabric of the flap 50 in engagement with end 100 of tongue 56. Note that each end 100 is rounded in this embodiment. This enables flap 50 to slide freely over end 100 as tongue 56 is moved radially inwardly and outwardly (arrow 118) to enlarge and shrink the diameter of hole 42. Spring 110 serves to remove slack in flap 50 as tongue 56 moves radially outwardly. Likewise, spring 110 can be overcome by radially inward movement of tongue 56 to enable a portion of flap 50 to be relocated onto a top surface 120 of tongue 56 as tongue 56 moves radially inwardly.

It is contemplated that counterforce springs (not shown) can be provided to balance the radially-outward force generated by springs 110 on tongues 56. It can be desirable to provide a neutral radial force balance on tongues 56 to increase motor life, allow the use of a lower-torque motor or to enable manual adjustment of hole size. Such springs can be disposed between the tongues and, for example, the base plate. The counterforce springs can exert a tension force in an equal and opposite radial direction relative to springs 110.

Each flap 50 corresponds to a tongue 56. Hence, each tongue 56 controls the positioning of a respective flap 50. As flaps 50 are driven onto respective top surfaces 120 of each tongue 56, the radial cuts (168) between flaps 50 essentially merge creating a continuous surface (see FIG. 1). The thickness of the grass material enhances the appearance of a continuous surface by obscuring the merged cuts (168). The portion of each flap 50 that underlies a respective tongue 56 remain separated from adjacent flaps due to tangential expansion as the material is folded back on itself. However, this portion is not seen by the player and does not effect the path of travel of the ball over rim 43. Rather, the radial cuts or slits (168) between flaps 50 are always merged adjacent the upper surface 120 of each tongue 56.

Note that upper plate 52 remains stationary relative to each tongue 56 (FIG. 5). Plate 52 can be joined to each separator 70 and to the more-outlying portion of the training device surface.

While playing surface 38 includes separated flaps 50, it is contemplated, according to an alternate embodiment, that flaps 50 can be joined along at least a portion of their surfaces by an expanding material such as an elastic webbing that would absorb the tangential expansion beneath the tongue. Similarly, the flexible material of playing surface can comprise an integrally expansive material with memory. In other words, a substrate of the playing material can comprise an elastic fabric allowing stretch in two dimensions. In such an embodiment, a circumferential portion of the material can simply be joined at various points about its circumference to an underside of base plate 58 with no slits or cuts in the material. The material would stretch in two dimensions in response to radially inward movement of tongues 56 without separate springs. Likewise, the material would take up slack and follow a radially-outward retraction of tongues 56. It is contemplated primarily that such a material include "expansion areas" that enable the material to flex in response to radially-inward and radially-outward movement of a rim structure. Accordingly, such "expansion areas" can comprise the majority of the playing surface material or, alternatively, can comprise specified portions of the playing surface material. Cuts or slits as defined herein are considered a type of "expansion area".

Figure 6:
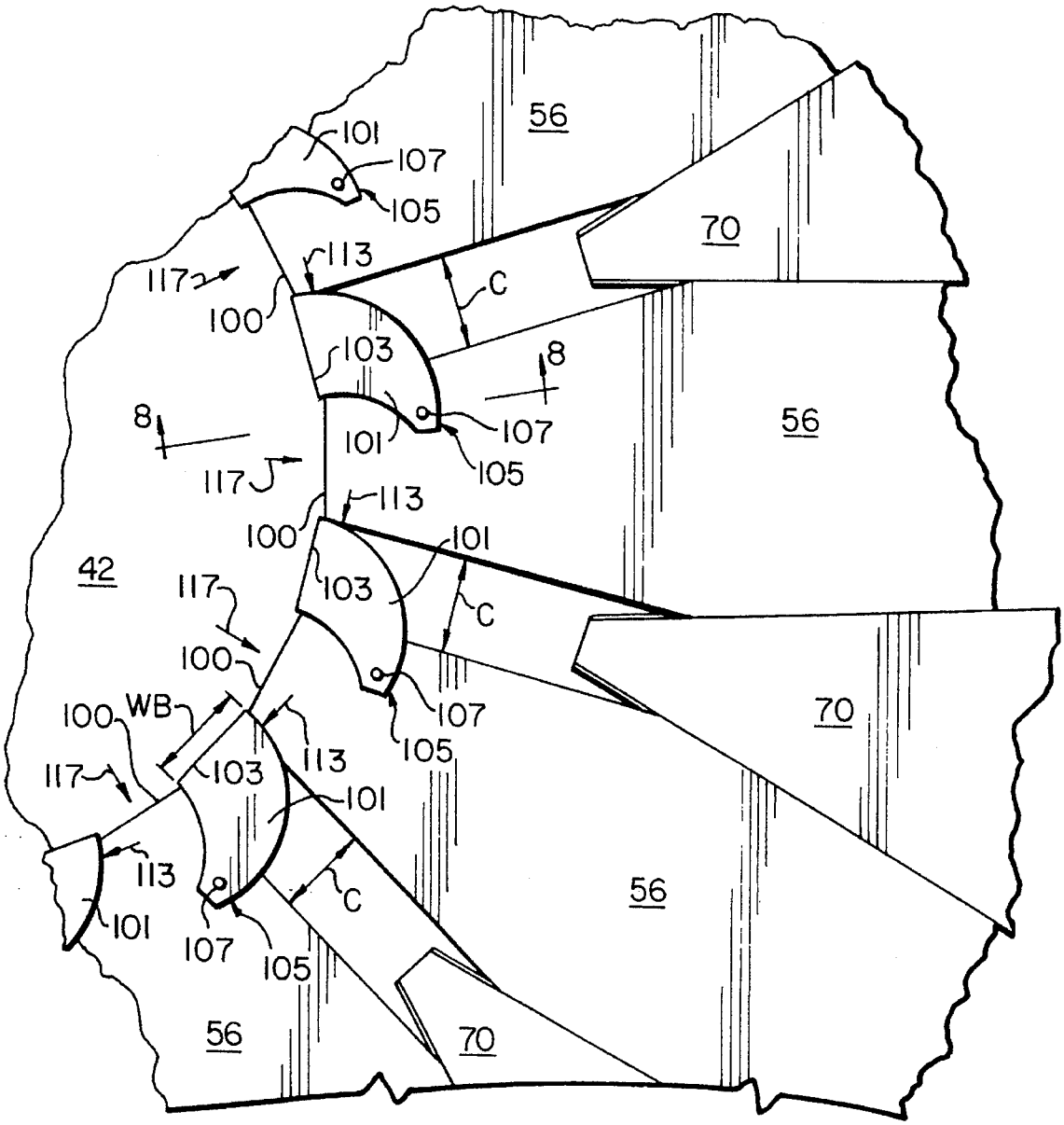
FIG. 6 is a partial plan view of the practice hole mechanism detailing a gap-bridging structure, according to an alternate embodiment, wherein the hole is defined by a maximum diameter rim.

In a preferred embodiment, each flap 50 is wrapped over an end 100 of a corresponding tongue 56. It is contemplated that a pair of flaps 50 can be wrapped over adjacent areas of an end 100 and that each of the flaps can overlap onto a pair of adjacent tongue ends 100. In other words, each tongue 50 can share a pair of flaps with each flap supported by a portion of respective end 100 of adjacent pairs of tongues 56. This arrangement is shown in FIG. 6 in which each slit 168 overlies a tongue 56. An advantage to this arrangement is that it helps to obscure the discontinuities in the circle due to clearance C between tongues and due to the linearity of each end. Since the material of playing surface 38 maintains some rigidity over short spans, it defines a largely circular rim over the tongue ends 100, despite the segmented appearance. Note that ends 100 can be curved to more closely approximate a circle of a given diameter. Likewise, a movable bridging framework can be provided between tongues to further support the material between gaps C.

Figure 7:
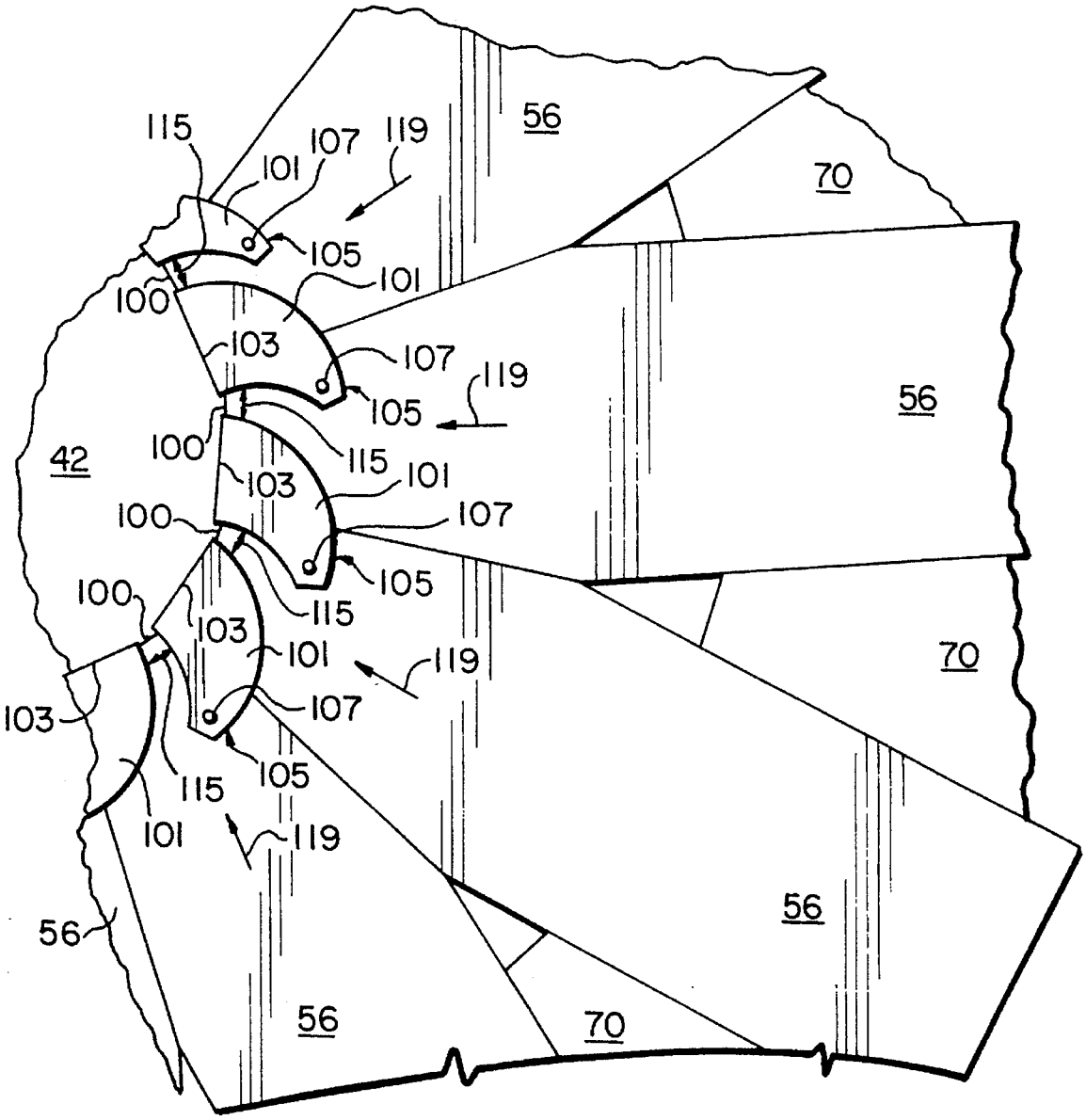
FIG. 7 is a partial plan view of the practice hole mechanism of FIG. 6 wherein the hole is defined by a minimum diameter rim.
Figure 8:
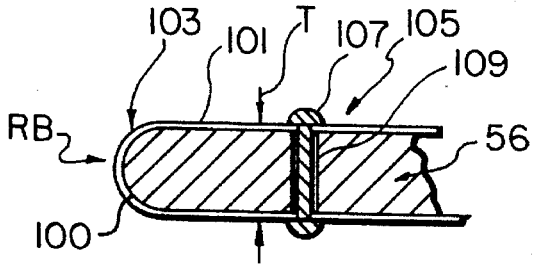
FIG. 8 is a partial cross-section of a tongue and gap-bridging structure taken along line 8—8 of FIG. 6.
Figure 9:
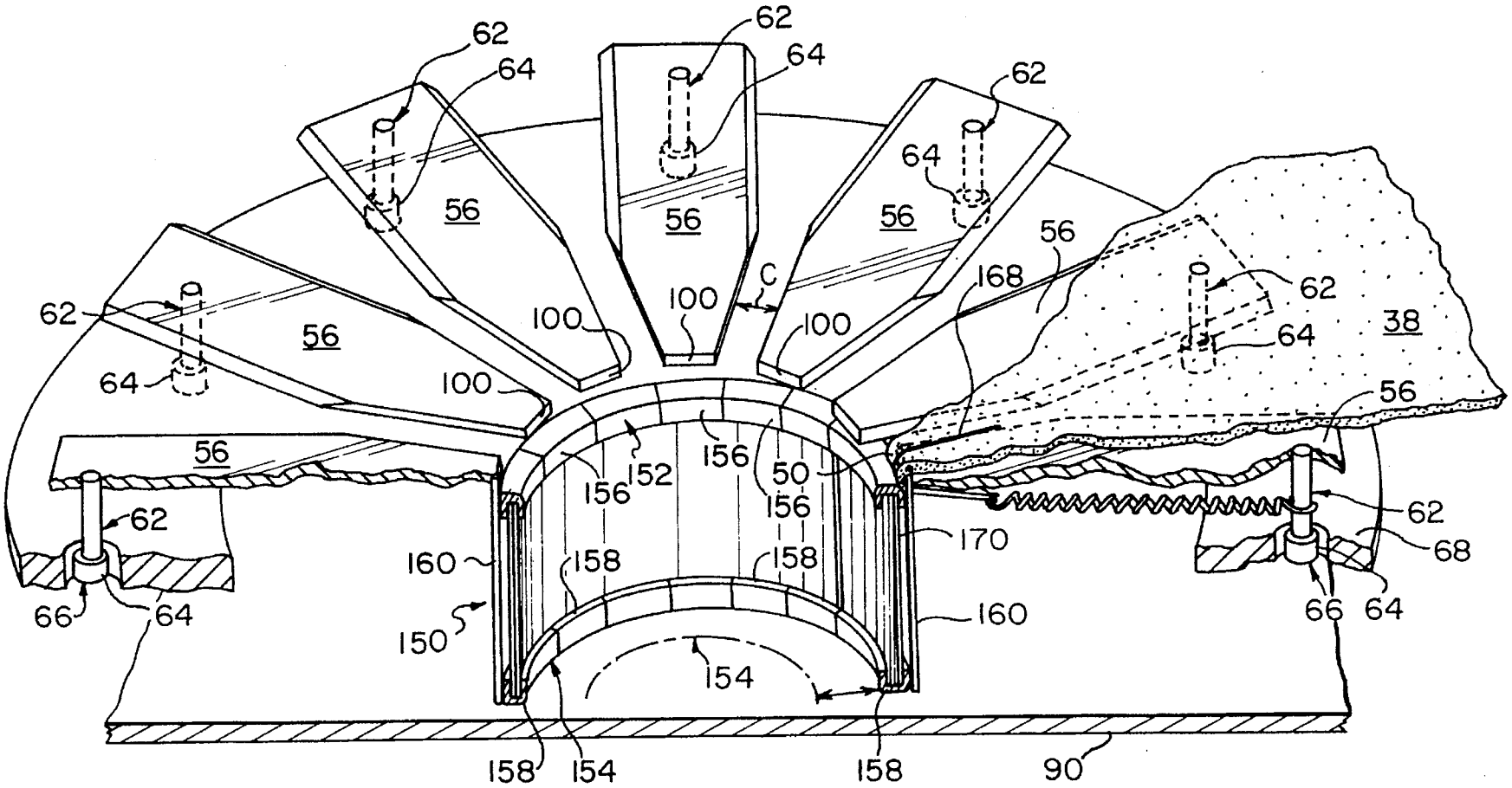
FIG. 9 is an exposed perspective view of the practice hole mechanism detailing an adjustable-size cup according to this invention.

An example of a bridging framework is detailed in FIGS. 6–8. A series of bridging structures 101 are secured adjacent the ends 100 of each respective tongue 56. Bridging structures 101, according to this embodiment, are constructed from 30-gauge sheet steel into a "U" shape as detailed in FIG. 8. Other thin-walled materials are also contemplated such as certain plastics. The forward or front edge 103 of bridging structure 101 includes a radius RB that, in this embodiment, is approximately 0.125 inch and conforms to a curvature of tongue end 100. The spacing T (FIG. 8) of the bent sides of bridging structure 101 conforms closely to a thickness of the tongue. In this embodiment, the thickness of tongue 56 can be 0.25 inch and the bridging structure spacing T can closely conform to this value.

Each bridging structure 101 is formed to include a forward or front edge 103 that, in this embodiment, substantially linear and then offset tail section 105. Tail section 105 is offset so that forward edge 103 can span gap C between tongue 56 while tail section 105 is located fully upon the surface of respective tongue 56. Each tail section 105 is secured to respective tongue 56 by a rivet 107, or like fastener, that passes through a corresponding hole 109 (FIG. 8) in each tongue 56. Each bridging structure 101 is substantially fixed relative to its respective tongue 56. However, each bridging structure 101 is free to slide tangentially (arrows 113 and 115 in FIGS. 6 and 7) in response to respective radial movement (arrows 117 and 119) of tongues 56. Since each bridging structure 101 overlies a tongue that is directly adjacent to the tongue to which the respective bridging structure 101 is attached, it slides freely in a tangential direction over the adjacent, unattached, tongue.

The width WB (FIG. 6) of each bridging structure end 103 is chosen so that, at a maximum diameter (FIG. 6), the gap C is fully bridged while, at a minimum diameter (FIG. 7), the bridging structures 101 do not interfere with each other. Since the thickness of each bridging structure 101 is relatively small, a playing surface can be located over tongue ends 100 and bridging structures 101 without a substantial discontinuity on the top surface of the rim. The bridging structures 101 effectively smooth discontinuities created by gaps C between tongue 56 and generate a more-continuous hole rim that enhances support of the playing surface material at larger diameter rim settings.

While the bridging structures 101 described herein are fixed relative to their respective tongues 56, however, it is contemplated that a retractable bridging structure can be utilized according to an alternate embodiment. Such a retractable bridging structure can include a series of spring-loaded blocks (not shown) that extend tangentially relative to each tongue as the gap C is opened.

Conventional golf holes traditionally include a recessed cup, constructed from plastic or another durable material, for receiving the golf ball after a successful shot. FIGS. 9–12 illustrate a golf practice hole mechanism according to this invention that includes a variable geometry cup liner 150.

Figure 10:
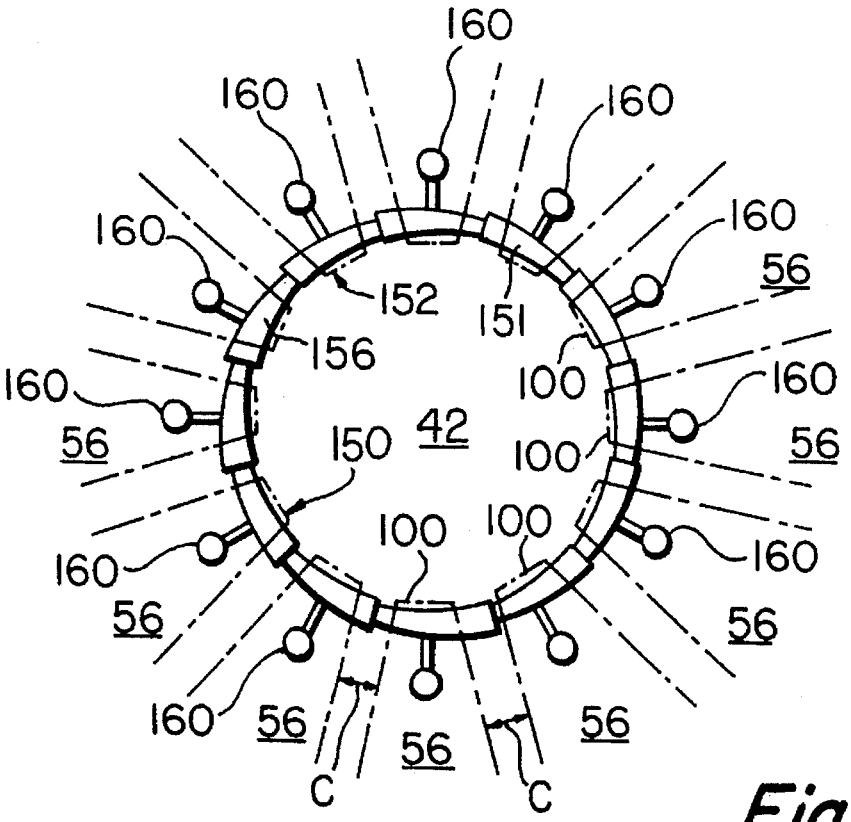
FIG. 10 is a partial plan view of the cup of FIG. 9.
Figure 11:
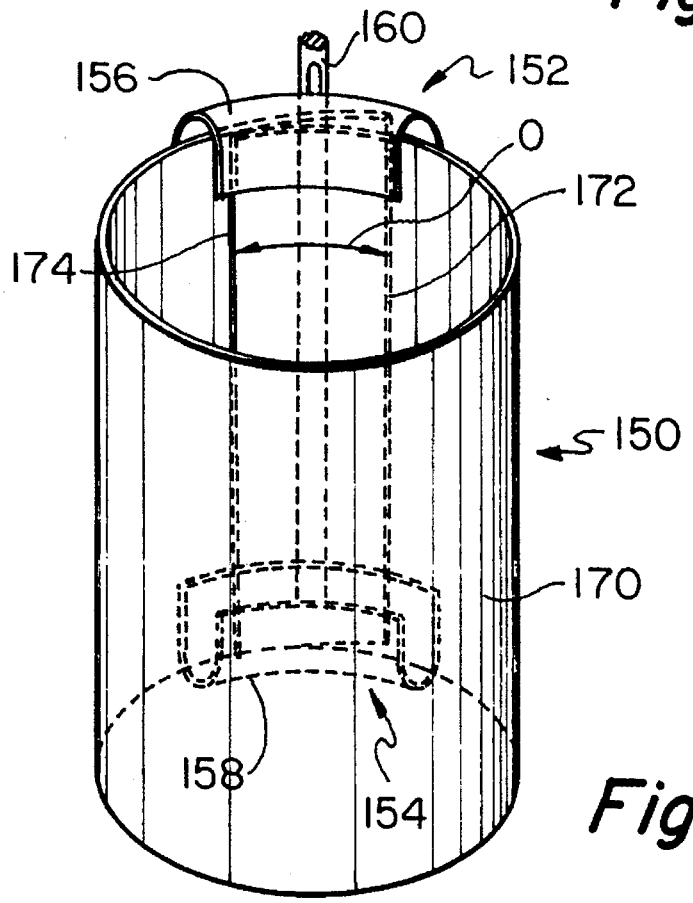
FIG. 11 is a partial perspective view of the cup of FIG. 9.
Figure 12:
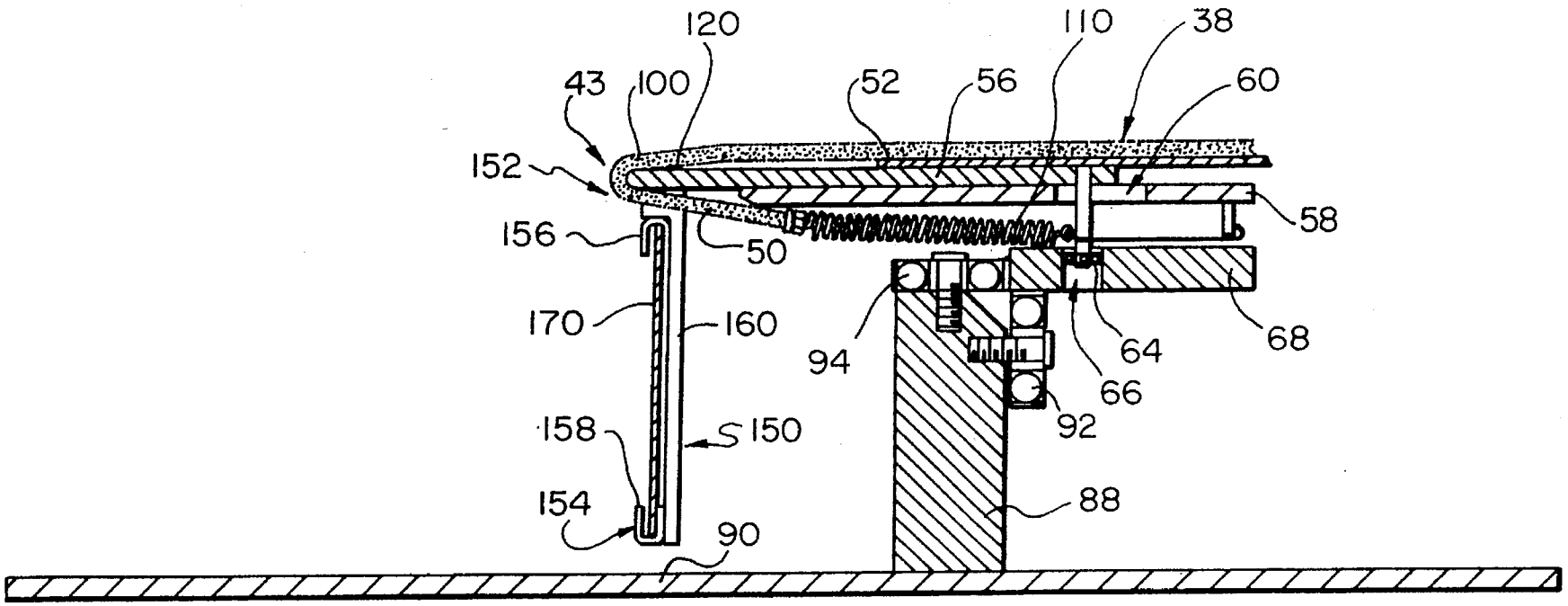
FIG. 12 is a partial side cross-section of the practice hole mechanism including the cup of FIG. 9.
Figure 13:
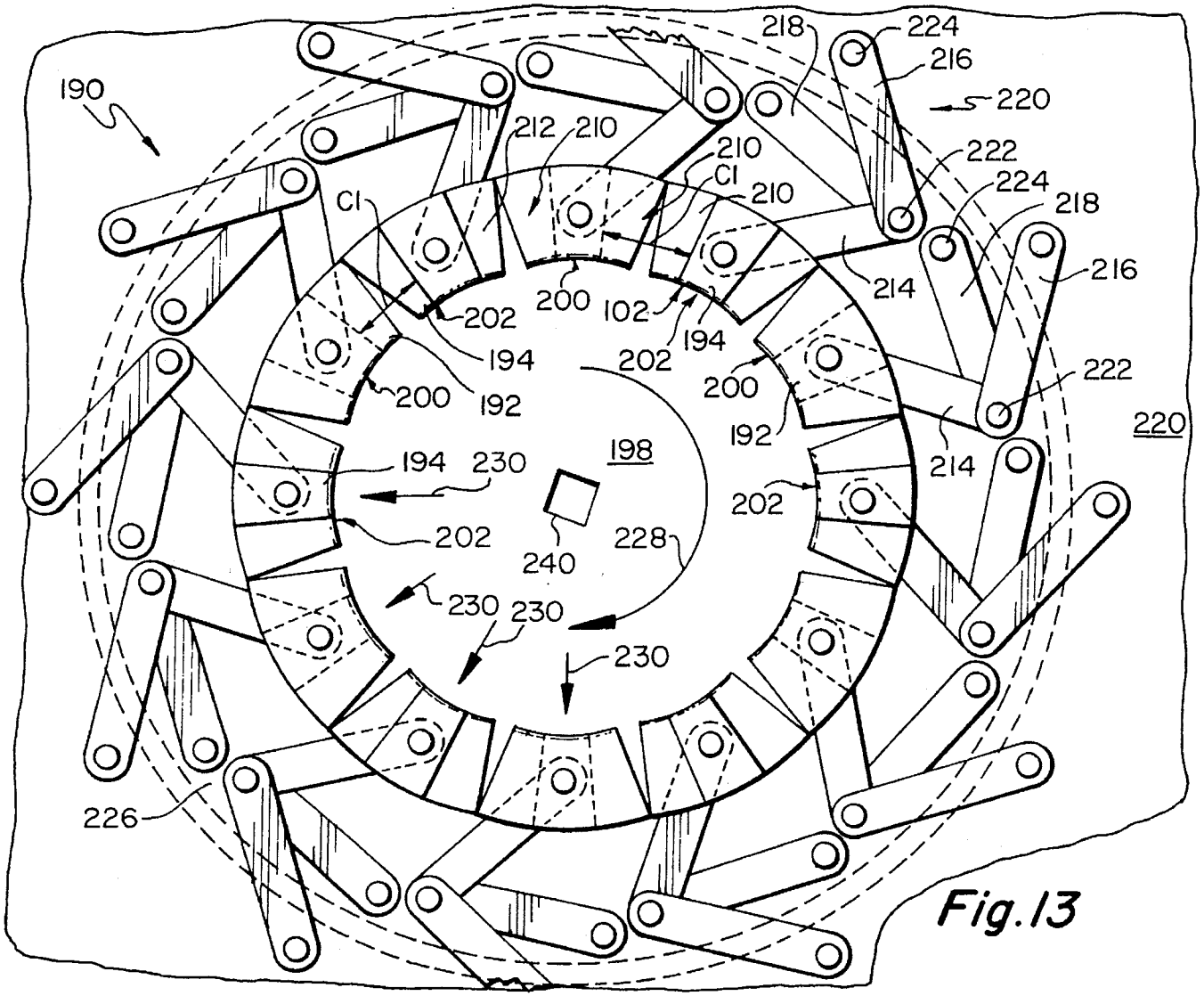
FIG. 13 is a plan view of an alternate embodiment of a practice hole mechanism defining a maximum diameter rim according to this invention.

The cup 150 according to this embodiment comprises an upper rim structure 152 and a lower rim structure 154. Upper rim structure 152 and lower rim structure 154 comprise a plurality of segments of U-shaped channels 156 and 158, respectively. As detailed in FIG. 10, each U-shaped channel segment 156, 158 is located adjacent a respective end 100 of a tongue 56. Channel segments 156, 158 overlap each other to form an endless interconnected ring (FIG. 10). In other words, the inner surface of each channel segment 156, 158 overrides a portion of an outer surface of an adjacent channel segment 156, 158. In this manner, as a diameter of hole 42 increases or decreases channel segments 156, 158 slide relative to each other to form a larger or smaller corresponding rim. In this embodiment, each of channel segments 156, 158 is supported on a central post 160. Central post 160 of each pair of segments 156, 158 is interconnected with a respective tongue 56 and moves radially-inwardly and outwardly as tongue 56 moves radially-inwardly and outwardly.

In this embodiment, rims 152 and 154, defined by respective segments 156, 158 are located below tongue ends 100 to form a fully-recessed cup. Playing surface material 38, according to this embodiment, is divided along slits or cuts 168 that fall upon each tongue end 100. Support bars 160 are located on the bottom center of each tongue and each flap 50 passes around support bar 160 with each slit 168 centered relative to each support bar 160. It is also contemplated that support bars 160 can be offset relative to each tongue 56 so that a respective flap 50 can be fully centered relative to each tongue 56. As described above, one advantage to locating each slit 168 along an approximate center of a tongue 56 is that flap 50 bridges gap C between respective tongues 56. The bridging effect forms a more-continuous circular rim with fewer visible breaks or discontinuities.

Rims 152 and 154 define opposing, substantially-continuous, channels that capture a flexible wall 170. Wall 170 can comprise a relatively-thin-walled polyethylene sheet, or a similar flexible material, that remains somewhat rigid while curled about itself. Wall 170 is secured between rims 152 and 154 with a slight overlap O (FIG. 11) that remains when rims 152 and 154 are located at a maximum diameter. Overlap O increases as the diameter of rims 152 and 154 is decreased. The channels formed by rims 152 and 154 should be sufficiently wide to enable a two-ply thickness of wall 170 to move freely within the channels 152, 154, but should be narrow enough to prevent excessive play in wall 170.

In this embodiment, bottom rim 154 defines an open bottom that is in communication with bottom plate 90. Hence, a ball passing over material rim 43 and into cup 150 strikes bottom plate 90. It is contemplated that bottom plate 90 can include a structure for holding a conventional golf flag for added realism. Likewise, a more-realistic frusto-conical bottom structure can be provided adjacent cup 150. Cup 150 would typically move relative to the bottom structure which would remain stationary. Conversely, the bottom structure could be constructed with a variable-geometry by providing radially-inwardly projecting extensions from bottom rim segments 158.

Since wall 170 of cup 150 always includes an overlap O (FIG. 11) it can be non-permanently attached to rims 152 and 154. Conversely, one edge 172 or 174 (FIG. 11) can be permanently attached to corresponding adjacent rim segments 156 and 158. The opposing edge 174 or 172, respectively, should freely float to enable expansion and contraction of the cylinder defined by wall 170.

Figure 14:
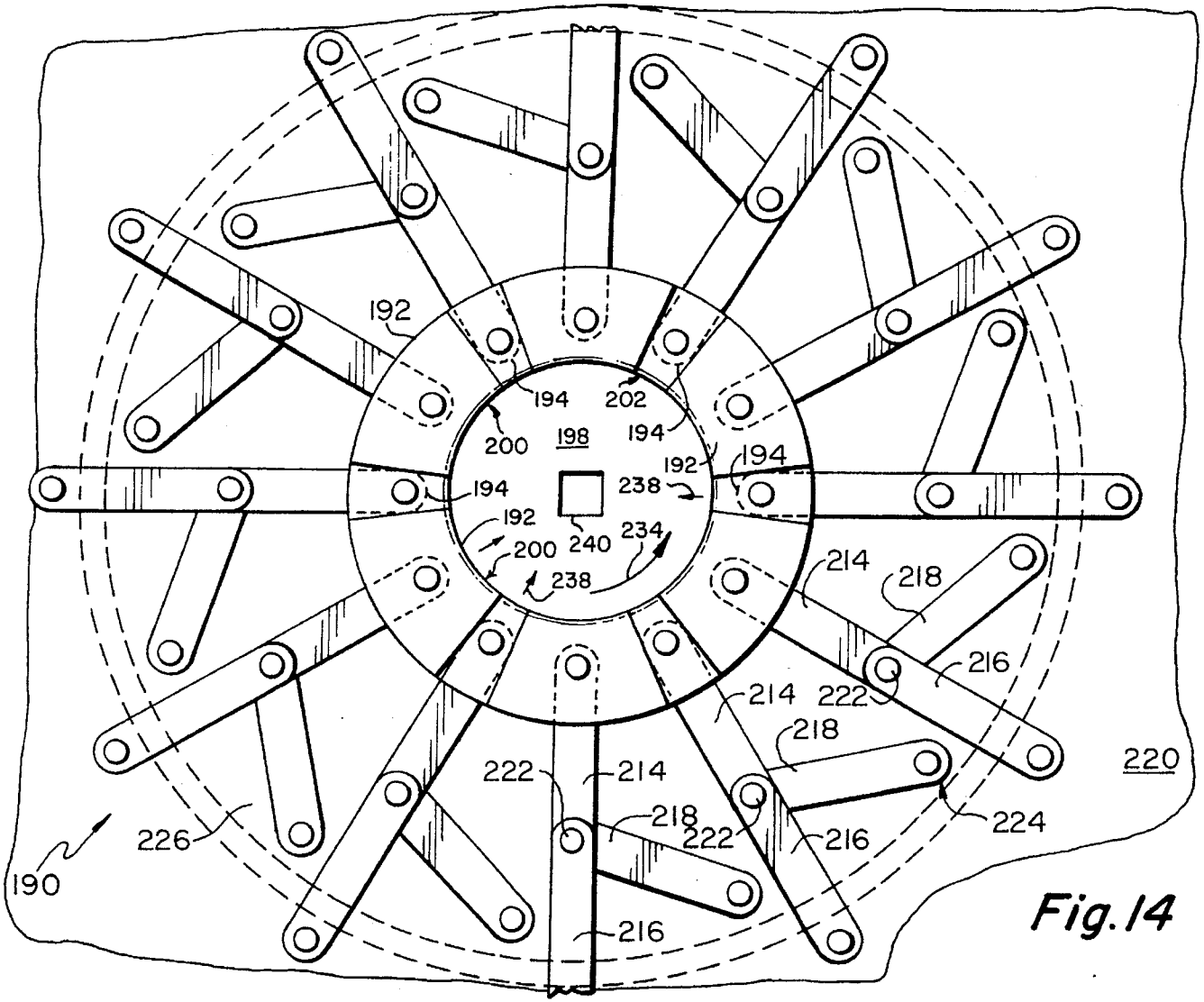
FIG. 14 is a plan view of the practice hole mechanism of FIG. 13 defining a minimum diameter rim according to this invention.

FIGS. 13–18 illustrate an alternate embodiment of a variable diameter golf practice hole rim according to this invention. The mechanism 190 operates similarly to the mechanism described in the embodiments of FIGS. 2–5. A series of rim-defining blocks 192 and 194 define an inside edge 196 of a golf practice hole 198. Blocks 192 and 194 move radially-inwardly and radially-outwardly between a minimum diameter (FIG. 14) and a maximum diameter (FIG. 13), respectively, to provide a variable diameter golf hole rim. The blocks 192 and 194 have curved edges 200 and 202, respectively, that, in this embodiment, define a circumference of a circle. In particular, the profile of the edges 200 and 202 is chosen so that a substantially-continuous circle is defined when the blocks 192 and 194 are located at a minimum diameter position (FIG. 14). It is contemplated that the edges 194 can be aligned perpendicularly to the radial direction and be substantially linear like ends 100 of tongue 56 (FIGS. 2–5). Likewise, the edges can be formed to define a circle at a diameter that is different than the minimum diameter. In general, the playing surface material 208 (FIG. 15 and 16) exhibits sufficient rigidity to maintain an approximate outline of a circle throughout the complete range of movement of blocks 192 and 194 between a radially-inward-most (FIG. 14) and radially-outward-most (FIG. 13) orientation. The material 208 is overlaid on blocks 192 and 194 in a manner similar to surface 38 of the embodiment of FIGS. 2–5. It, hence, includes "expansion areas" and springs 248 that maintain material 208 in engagement with blocks 192, 194.

Figure 16:
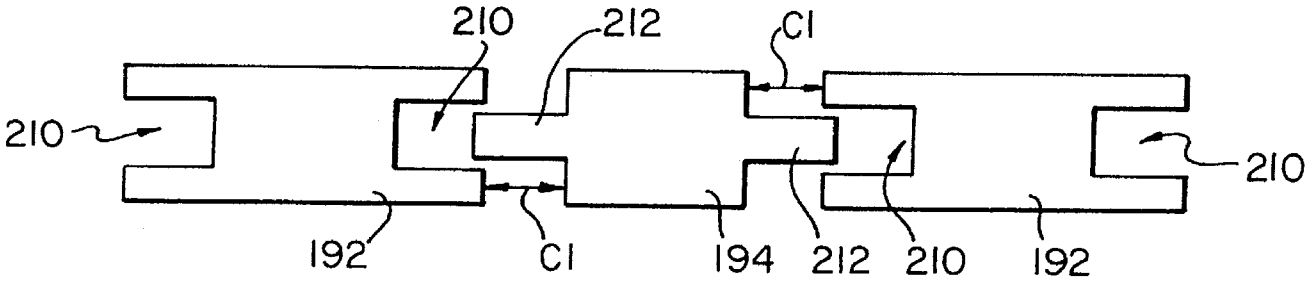
FIG. 16 is a partial front view of the practice hole mechanism in the orientation shown in FIG. 15.
Figure 15:
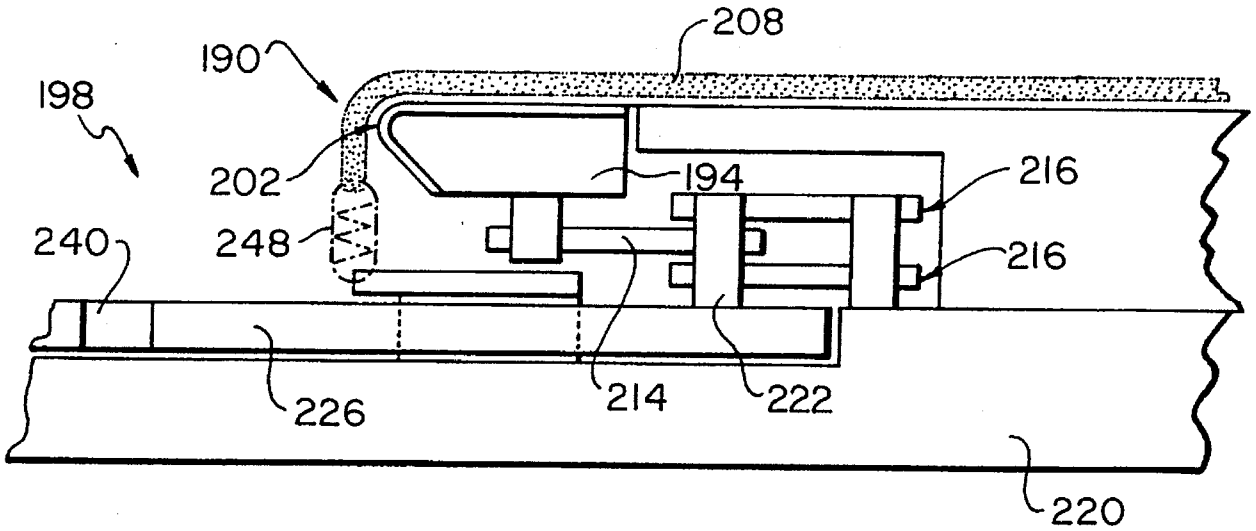
FIG. 15 is a partial side cross-section of the practice hole mechanism of FIG. 13 defining a maximum diameter rim.
Figure 18:
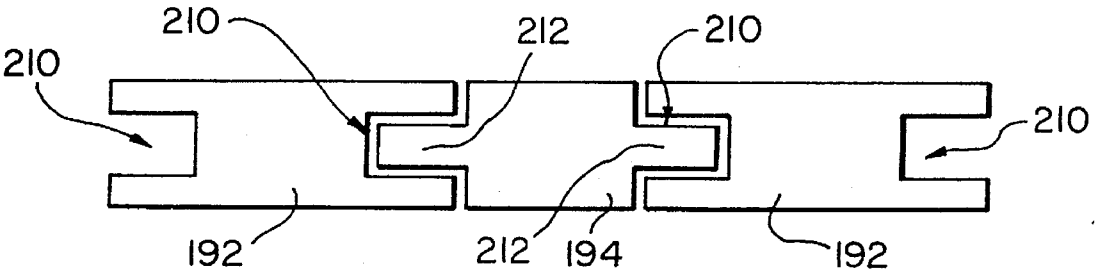
FIG. 18 is a partial front view of the practice hole mechanism in the orientation shown in FIG. 17.
Figure 17:
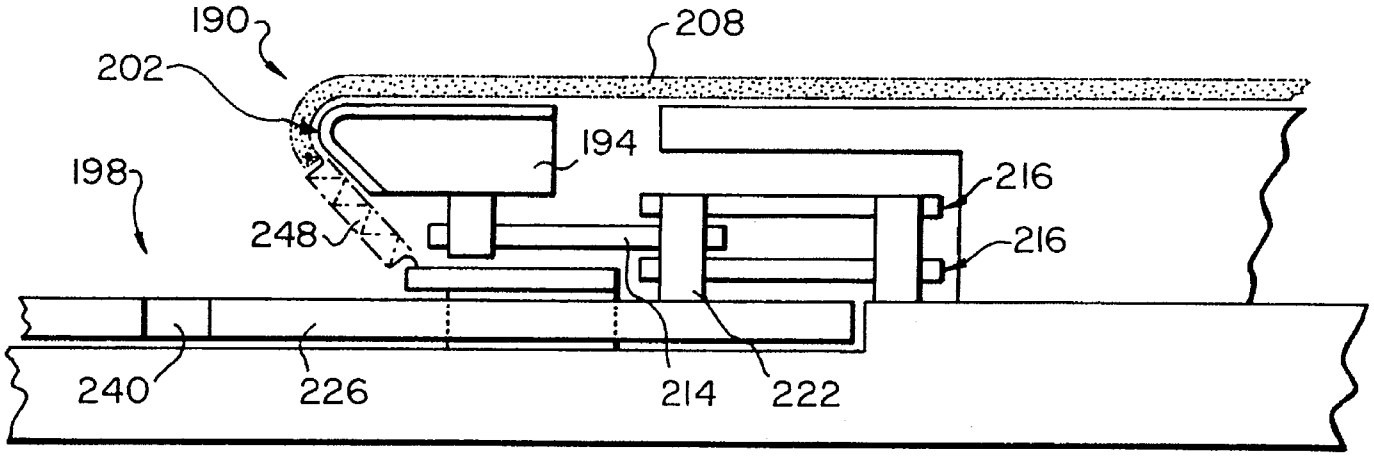
FIG. 17 is a partial side cross-section of the practice hole mechanism of FIG. 13 defining a minimum diameter rim.

Blocks 192 and 194 are detailed in front view in FIGS. 16 and 18 in a maximum-diameter and minimum-diameter orientation, respectively. Blocks 192 and 194 comprise a tongue and groove structure. Blocks 192 include grooves 210 adapted to receive corresponding tongues 212 in blocks 194. In a maximum-diameter orientation (FIG. 16) tongues 212 and grooves 210 are barely engaged. Conversely, in a minimum-diameter orientation tongues 212 and grooves 210 are fully-engaged (FIG. 18). The clearance C1 (FIGS. 13 and 16) between blocks 192 and 194 enables the blocks to be moved toward each other as they converge at a radial-inward-most orientation. Tongues 212 and grooves 210 ensure that all blocks 192, 194 remain in axial alignment at all times.

Movement of blocks 192 and 194 radially inwardly and radially-outwardly is controlled by respective sets of arms 214, 216 and 218. Arms 216 are pivotally connected to a fixed base plate 220. Arms 216 are pivotally connected at their opposing ends to arms 214. Similarly, arms 214 are pivotally connected to respective blocks 192 and 194. The set of arms 214 and 216, hence, have the ability to fold along a direction transverse to the radial direction. Hence, arms 214 and 216 can move between a fully-extended (FIG. 14) to a fully-folded (FIG. 13) state. Full extension of arms 214 and 216 is controlled by control arms 218. Control arms 218 are each connected at a respective common pivot point 222 of each set of arms 214 and 216. Control arms 218 are pivotally connected at their opposing ends to a pivot point 224 on a rotating inner base plate 226. Inner base plate 226 rotates relative to fixed base plate 220. Hence, rotation of inner base plate 226 in a clockwise direction (arrow 228 in FIG. 13) causes control arms 218 to bear upon pivot points 222 to fold arms 214 and 216. Folding of arms 214 and 216 causes blocks 192 and 194 to retract radially-outwardly (arrows 230). Likewise, rotation of inner base plate 226 relative to fixed base plate 220 in a counterclockwise direction (arrow 234 in FIG. 14) causes arms 218 to pull upon pivot points 222 to form the arms 214 and 216 into a radially-aligned orientation in which blocks 192 and 194 move radially-inwardly (arrows 238). It is contemplated that inner ring 226 can be rotated by any acceptable mechanical or electromechanical device. In this embodiment a keyhole 240 is located at the center of the inner ring 226. Keyhole 240 receives a key (not shown) or a wrench of conforming size that is passed through the practice hole 198 and into engagement with the keyhole 240.

It is contemplated that a covering plate such as plate 52 in the embodiments of FIGS. 2–5 can be utilized at a location over mechanism 190. Likewise, it is contemplated that the playing surface tensioning springs 248 (FIGS. 15 and 17) can be substituted for other tensioning devices, or for a flexible playing surface material. A movable cup can also be provided within hole 198.

Figure 19:
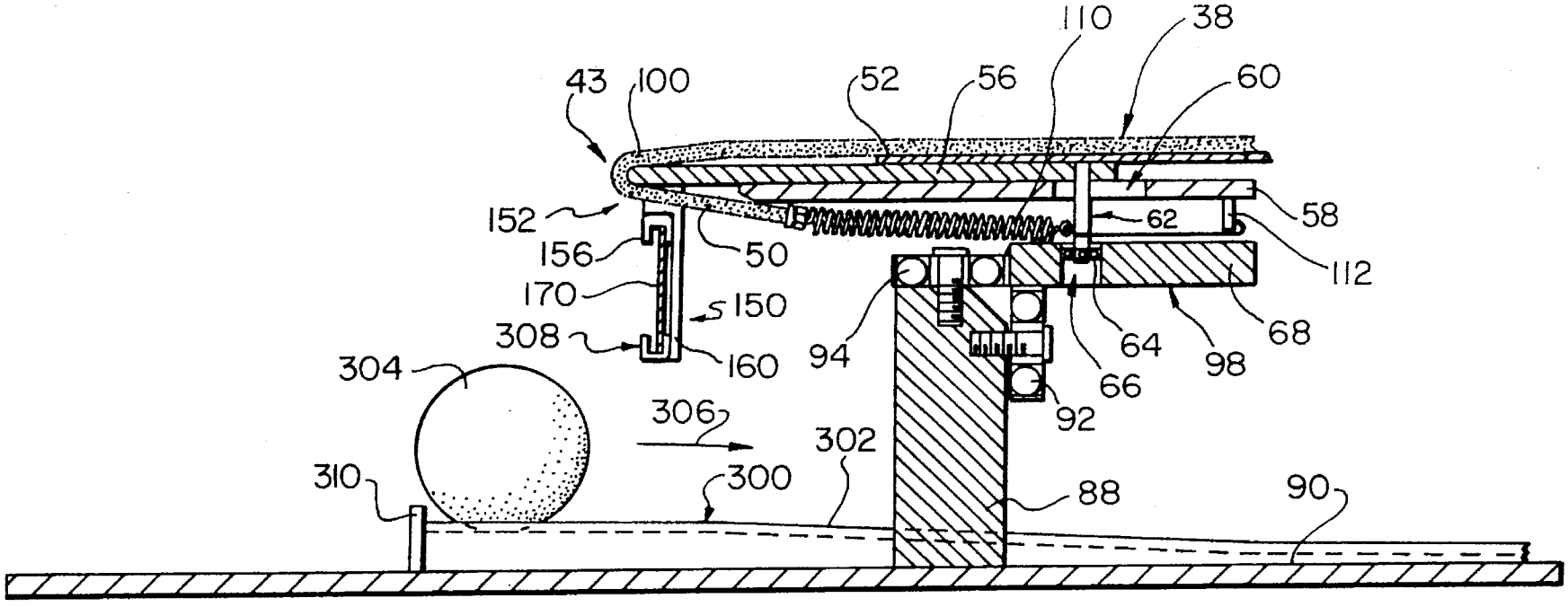
FIG. 19 is a side cross-section of a modification to the practice hole of FIGS. 9–12 including a ball return mechanism.

FIG. 19 illustrates a modification of the embodiment of FIGS. 9–12 in which a ball return ramp 300 is provided beneath the cup 150. The ramp 300 can comprise a trough-shaped guideway 302 that slopes downwardly away from the cup 150 to direct a ball 304 along a path (arrow 306) beneath playing surface 38 to a remote location that can be, for example, adjacent the player. In this embodiment, at least a portion of cup 150 that overlies ramp 300 has been raised in height to enable ball 304 to pass beneath lower rim 308. A backstop 310 is provided to prevent ball 304 from exiting an uppermost end of ramp 300.

It should be clear from the discussion of the proceeding embodiments, that a variety of mechanisms can be utilized in conjunction with a flexible playing surface material that includes expansion areas to form a changeable diameter rim for a golf practice hole. While the proceeding embodiments have employed blocks or tongues that move radially-inwardly and radially-outwardly relative to a hole center to define a rim of the hole, it is expressly contemplated that other mechanisms for enlarging and reducing a diameter of the rim can be utilized. For example, a series of wedges that rotate in the manner of a camera shutter can be utilized. Likewise, a flexible cable or spring that defines supporting rim of a hole and that can be tensioned and loosened to change a diameter of the hole can be utilized as a support for the flexible material.

The practice device according to the various embodiments described herein can be constructed from a variety of generally-accepted materials. For example, tongues can be constructed from a plastic, such as Delrin®, or metal, such as 6061-T6 hardness aluminum alloy. Likewise, base plates, adjustment rings and arms can be constructed from aluminum, plastic or a similar material. Separators between tongues can be constructed from Delrin® or a similar plastic to provide a low-friction bearing surface. The base plate on which the mechanism rests such as base plate 58 (FIG. 2) can be constructed from aluminum and can be sufficiently strong to enable a player to stand upon all or a portion of playing surface 38.

The foregoing has been a detailed description of several embodiments of the invention. Various modifications and additions can be made without departing from the spirit or scope of the invention. For example, while a round hole is utilized according to this invention, it is contemplated that a variable-geometry hole having a polygonal or non-circular rim shape can be generated. For example, various slots on a control ring can be located to define an ellipse rather than a circle. Some portions of the rim support mechanism can close at differing rates than other portions to generate a changing hole rim shape (i.e. from a circle to an ellipse). Finally, while the training device shown and described herein is used specifically for golf practice, the concepts disclosed herein are applicable to a variety of structures that require a variable size hole with a substantially-continuous surrounding surface. The overall size and scale of such holes can, likewise, be made larger or smaller. Accordingly, this description is meant to be taken only by way of example not to otherwise limit the scope of the invention.

What is claimed:

1. An apparatus for defining a variable-size hole on a continuous surface comprising:

a flexible material surface covering defining a hole having a center and having a plurality of expansion areas extending radially outwardly from the center;

a plurality of supports that are movable radially between a minimum radial extension and a maximum radial extension relative to the center; and wherein the supports engage the flexible material surface adjacent the expansion areas and the flexible material is wrapped about the supports so that the material defines a rim of the hole and wherein radial movement of the supports changes a diameter of the rim.

2. The apparatus as set forth in claim 1 wherein at least some of the expansion areas comprise separated edges between portions of the flexible material surface.

3. The apparatus as set forth in claim 1 wherein each of the plurality of supports includes a linkage constructed and arranged to move each of the plurality of supports radially approximately an identical distance relative to each other of the plurality of supports.

4. The apparatus as set forth in claim 3 wherein the linkage comprises a plurality of guides located on each of the supports and a rotating plate having a plurality of slots that engage each of the plurality of guides wherein the plate is constructed and arranged so that rotation thereof causes the guides to move along the slots to, in turn, move the plurality of supports radially.

5. The apparatus as set forth in claim 1 further comprising a cup having a rim and a cup wall adjacent the rim that defines a cup within the hole.

6. The apparatus as set forth in claim 5 wherein the cup wall defines a flexible material sheet having sheet edges that overlap at a predetermined location and a frame that moves the sheet to relocate the sheet edges relative to each other in response to movement of the supports.

7. The apparatus as set forth in claim 6 wherein the frame comprises a pair of rims having a plurality of rim segments that overlap each other and move slidably relative to each other, at least one of the rim segments being interconnected with each of the plurality of supports, respectively, and the segments being constructed and arranged to move radially in response to radial movement of each of the plurality of supports, respectively.

8. The apparatus as set forth in claim 1 further comprising an intermediate base layer located between the flexible material surface and the plurality of supports and having a rim that defines a hole in the intermediate base layer adjacent the rim of the material.

9. The apparatus as set forth in claim 1 further comprising a spring material that engages the flexible material and that maintains the flexible material in engagement with the supports as the supports are moved radially.

10. The apparatus as set forth in claim 9 wherein the spring material comprises a plurality of tension springs that extend approximately radially outwardly away from the center and along a side of each of the plurality of supports, respectively, opposite a side of each of the plurality of supports that faces the flexible material surface.

11. The apparatus as set forth in claim 10 wherein the flexible material surface comprises a plurality of flaps separated by cuts that are aligned approximately radially relative to the center and wherein each of the flaps engage at least one of the plurality of supports.

12. The apparatus as set forth in claim 1 further comprising a ball return guideway located adjacent the rim of the hole constructed and arranged to guide a ball to a location remote from the rim.

13. The apparatus as set forth in claim 1 further comprising a motor and a motor control interconnected with each of the plurality of supports constructed and arranged to move each of the plurality of supports radially.

14. A golf practice hole comprising:

a flexible surface located on a curtilage that surrounds the practice hole and that defines an approximately circular rim of hole having a diameter; and a movable support mechanism located on the curtilage beneath the flexible surface and engaging the flexible surface at the rim to support and define the rim, the movable support mechanism being constructed and arranged to change the diameter of the rim between a minimum diameter and a maximum diameter.

15. The golf practice hole as set forth in claim 14 wherein the flexible surface comprises a mat that is simulative of putting green turf.

16. The practice hole as set forth in claim 14 wherein the movable support mechanism comprises a plurality of supports that move in an approximately radial direction toward and away from a center of the hole.

17. The golf practice hole as set forth in claim 16 wherein the flexible surface includes a plurality of expansion areas constructed and arranged to enable a portion of the flexible surface to expand in a direction substantially transverse to a radial direction in response to movement of the support mechanism to change the diameter of the rim.

18. The golf practice hole as set forth in claim 17 wherein the flexible surface includes a tensioning structure that maintains the flexible surface in engagement with the movable support mechanism as the movable support mechanism changes the diameter of the rim.

19. The golf practice hole as set forth in claim 18 wherein the tensioning structure comprises a plurality of springs that engage portion of the flexible surface and construction arrange to force the flexible surface into a wrapped orientation wherein portions of the flexible surface are located below the rim and beneath the curtilage.

20. A method for changing a diameter of a rim of a hole comprising the steps of:

providing a surface having an open center and supports on the surface, the supports each defining a portion of an edge of a rim of a hole;

locating a flexible material over the surface;

wrapping the material about the supports so that the material extends beneath the surface movably tensioning the material at a location beneath the surface to define a rim of the material at a location in which the material is wrapped about the supports; and moving the supports toward and away from the open center to change a diameter of the rim.

21. The method as set forth in claim 20 wherein the step of moving includes translating a plurality of supports having edges that define a rim in an approximate radial direction toward and away from the open center.

22. The method as set forth in claim 20 wherein the step of movably tensioning includes applying a spring force to the material at predetermined locations thereon to maintain the material in engagement with the supports.

23. The method as set forth in claim 20 wherein the step of locating includes providing a flexible material having a plurality of expansion areas that enable expansion of material in a direction substantially transverse to a radial direction relative to the open center and expanding the material at the expansion areas in response to this step of moving.

24. The method as set forth in claim 23 wherein the step of providing expansion areas includes cutting the material to form a plurality of radial cuts relative to a material center point aligned with the open center that define individual flaps of material, and wherein the step of wrapping includes wrapping the flaps about the supports.

25. The method as set forth in claim 24 wherein the step of movably tensioning includes applying a spring force to each of the flaps.

* * * * *